United States Patent [19]

Schuster

[11] Patent Number: 4,815,599

[45] Date of Patent: Mar. 28, 1989

[54] WRAP-AROUND CARRIER FOR BOTTLES

[75] Inventor: Richard L. Schuster, West Monroe, La.

[73] Assignee: Manville Corporation, Denver, Colo.

[21] Appl. No.: 210,161

[22] Filed: Jun. 20, 1988

Related U.S. Application Data

[63] Continuation of Ser. No. 24,936, Mar. 12, 1987, abandoned, which is a continuation-in-part of Ser. No. 917,883, Oct. 14, 1986, abandoned.

[51] Int. Cl.[4] ..... B65D 75/00

[52] U.S. Cl. ..... 206/427; 206/434; 229/158; 229/52 BC;. 229/40

[58] Field of Search ..... 206/140, 152, 156, 157, 206/427, 434, 429, 141, 145, 1.5; 229/28 BC, 52 BC, 40, 45 R, 44 R, 158

[56] References Cited

U.S. PATENT DOCUMENTS

| | | | |
|---|---|---|---|
| 2,827,165 | 3/1958 | Gentry | 206/434 |
| 2,973,129 | 2/1961 | Stone et al. | 229/45 R |
| 3,014,636 | 12/1961 | Fielding | 206/427 |
| 3,395,791 | 8/1968 | Graser | 206/1.5 |
| 3,478,951 | 11/1969 | Graser | 206/434 |
| 3,674,137 | 7/1972 | Graser | 206/140 |
| 4,077,095 | 3/1978 | Oliff | 206/140 |
| 4,386,699 | 6/1983 | Sutherland | 206/434 |
| 4,433,807 | 2/1984 | Ganz | 229/40 |
| 4,437,606 | 3/1984 | Graser | 206/434 |
| 4,437,606 | 3/1984 | Graser | 229/40 |
| 4,574,997 | 3/1986 | Ikeda | 229/40 |
| 4,597,523 | 7/1986 | Schuster | 229/40 |
| 4,611,754 | 9/1986 | Sutherland | 229/40 |
| 4,681,217 | 7/1987 | Hernandez | 206/434 |
| 4,749,123 | 6/1988 | Ganz | 206/427 |

*Primary Examiner*—David T. Fidei
*Attorney, Agent, or Firm*—John D. Lister

[57] ABSTRACT

A wrap-around beverage carrier designed to carry four bottles. The bottom panel comprises two overlapping interlocked flaps foldably attached to the side panels, the overlying flap having primary locking tabs in engagement with primary locking slots in the underlying flap. The underlying flap further has a single centrally located secondary punch-style arrow-shaped locking tab which engages a secondary locking opening in the overlying flap. The overlying flap also has two tertiary locking tabs which engage tertiary locking openings in the underlying flap. The primary locking tabs consist of either a single or two closely spaced centrally located oversized position locking tabs and two outwardly spaced undersized position locking tabs, the oversized position tab being operable when oversize bottles are in the package and the undersized position tabs being operable when undersize bottles are in the package. The tertiary locking tabs can be punch-style tabs located inwardly from the ends of the carrier or outboard tabs located at the ends of the carrier.

3 Claims, 3 Drawing Sheets

50
48
50
58
58
52
34
54
56
20
22
14
16
28
24
26
12
30
11
26
24
28
16
14
22
20
32
42
40
42
44
44
36
46
38

36
32
44
44
58
46
60
54
38
34

32
44
46
34
54
38

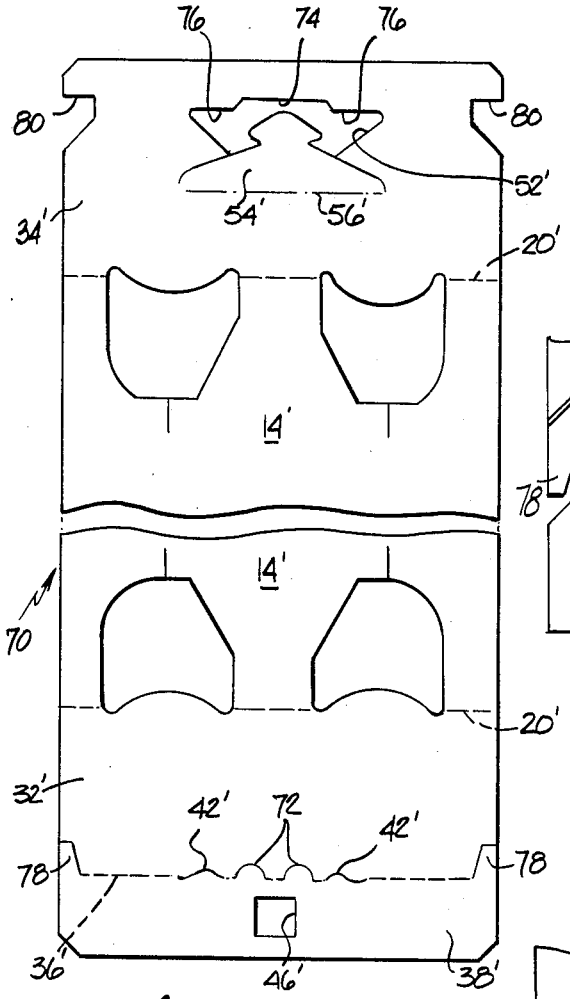
Fig. 7.
Fig. 8.
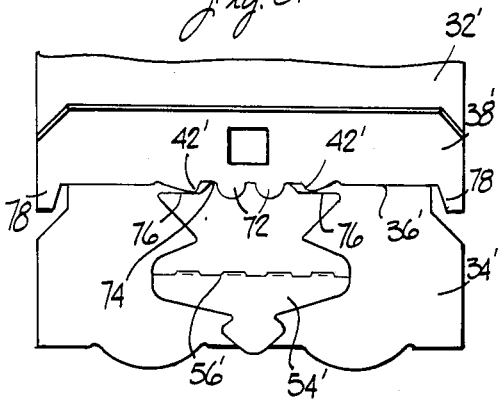
Fig. 9.
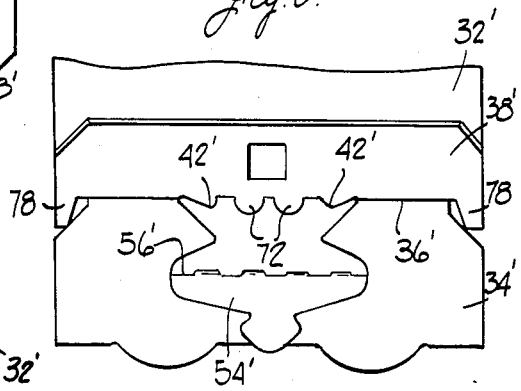
Fig. 10.
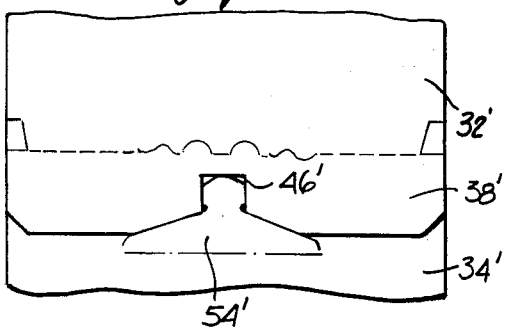

WRAP-AROUND CARRIER FOR BOTTLES

CROSS REFERENCE TO RELATED APPLICATION

This is a continuation of application Ser. No. 024,936, filed 3/12/87 is a continuation-in-part of application Ser. No. 06/917,883 filed Oct. 14, 1986.

FIELD OF THE INVENTION

This invention relates to a wrap-around bottle carrier, and more particularly to a wrap-around carrier designed to hold four beverage bottles.

BACKGROUND OF THE INVENTION

Beverage bottles are often packaged in wrap-around carriers made of paperboard sheet stock. The carriers are formed by wrapping paperboard blanks around the bottles to provide a package having two side panels foldably connected to top and bottom panels, usually leaving the ends of the carrier open. Openings in the side panels adjacent the bottom panel hold the heels or bases of the bottles in place and smaller openings in the top panel allow the necks of the bottles to protrude. A finger grip or handle in the top panel enables the user to readily lift the carrier.

The bottom panel of such carriers is normally formed from mechanically interlocked overlapping flaps which are foldably attached to the side panels. Various arrangements have been provided for locking the flaps together, one of the most popular and successful being a design which makes use of different sets of primary locking tabs and slots depending on the size of the bottles. This design takes into account the fact that all bottles of the same nominal size actually are not of exactly the same diameter, a phenomenon which tends to be even more noticeable in bottles having relatively thick foam labels.

An example of a carrier of this type is disclosed in U.S. Pat. No. 4,437,606, issued on Mar. 20, 1984 to Earl J. Graser. In the Graser arrangement two oversized position primary locking tabs located in the overlying bottom flap engage associated slots in the underlying bottom flap when the bottles are of such diameter that the girth or perimeter of the package is greater than a predetermined dimension. Two different undersized position primary locking tabs engage their associated slots when the perimeter of the package is less than the predetermined dimension. In addition, two secondary arrow-shaped punch locks connected to the underlying flap are received in associated locking openings in the overlying flap to prevent the primary locks from failing when the package is weakened through contact with water. Also, tertiary punch lock means are provided in the flaps to further strengthen the interlocking flaps and to assist in preventing the flaps from separating.

Although the Graser locking arrangement functions well, in practice it is commonly used in a carrier designed to hold six beverage bottles. While this is a popular style of carrier, there has nevertheless been a demand for packages holding only four bottles. In view of the success of the locking arrangement disclosed in Graser, bottling companies would prefer using the same design in the smaller package. This creates a number of problems.

On first glance one may think that because the package is narrower it would be sufficient to merely reduce the size of all the locking means and thereby utilize the identical locking arrangement disclosed in Graser. This approach could be thought to have some validity in view of the fact that the package would have two fewer bottles in it and therefore would have to carry less weight. In practice, however, this would not be adequate. If the locking tabs and punch locks were significantly reduced in size the areas of engagement of the tabs with their slots and the punch locks with their openings would be reduced to the point where they would be insufficient to withstand the stresses of lifting and carrying with the same margin of safety currently enjoyed in carriers designed to hold six bottles. Heavier paperboard could possibly be used to strengthen such an arrangement, but for economic reasons it would not be acceptable. If instead of reducing the size of the locking components they were retained at full size but simply squeezed closer together, the connecting portions between the tabs and punch locks would be narrowed to the point where they would become the weak link and would be in danger of tearing or yielding to lifting and carrying stresses. Again, heavier paperboard would not be a satisfactory solution.

It would therefore appear that a total redesign would be necessary, with the drawback that the features which work so well in the Graser design could not be used. It would be preferable, if the problems discussed above could be solved, to continue with the main features of the Graser design, modified to permit their use in a carrier for holding only four beverage bottles.

BRIEF SUMMARY OF THE INVENTION

This invention employs overlapping and interlocking bottom panel flaps having oversized and undersized position tabs as well as a secondary punch-style locking tab. Either a single oversized position tab or two closely spaced oversized position tabs are provided generally midway between the ends of the carrier. The secondary punch-style locking tab is also provided generally midway between the ends of the carrier. By this arrangement the locking components can be the same size as the locking components in carriers designed to hold six beverage bottles and they can be spaced apart as in the larger carriers so as not to reduce the width of the connecting portions between the tabs and openings. In this manner the carrier surprisingly can support the weight and the lifting and carrying stresses of four beverage bottles even though there are fewer locking components than previously employed. Tertiary locking means such as punch-style locking tabs or outboard locking tabs are also provided for extra locking support.

Other features and aspects of the invention, as well as its various benefits, will be made more clear in the detailed description of the preferred embodiment which follows.

BRIEF DESCRIPTION OF THE DRAWINGS

FIG. 7 is a partial plan view of a production blank for forming a carrier having modified oversized and tertiary locking tab arrangements;

FIG. 8 is a bottom view of the locking portion of a carrier formed from the blank of FIG. 7, showing the oversized position tabs engaging their associated slots during the process of locking the bottom flaps together;

FIG. 9 is a view similar to that of FIG. 8, but showing the undersized position tabs in engagement with their associated slots during the process of locking the bottom flaps together; and FIG. 10 is a bottom view of the locking portion of a carrier formed from the blank of FIG. 7 after the primary, secondary and tertiary locking tabs are in engagement with their associated female locking components.

DESCRIPTION OF THE INVENTION

Figure 1:
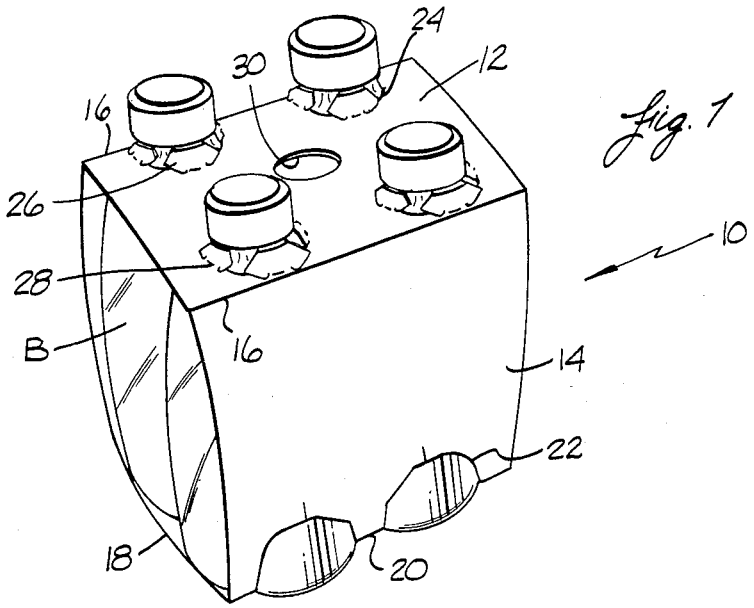
FIG. 1 is a pictorial representation of a wrap-around carrier of the type embodying the locking features of the present invention.

Referring to FIG. 1, the carrier 10 comprises a top panel 12 connected to side panels 14 by folds 16. Bottom panel 18 is connected to side panels 14 by folds 20. Cutouts 22 in the side panels 14 adjacent the bottom panel 18 receive the bases of bottles B and serve to hold the bottle bases in place. Openings 24 in the top panel allow the necks of the bottles to protrude through the top panel, and neck retainer tabs 26, foldably attached to the top panel by fold lines 28, serve to hold the bottle necks in place. A finger hold 30 in the center of the top panel permits the carrier to be lifted by the user. As shown, the carrier contains four bottles instead of the more usual six, each bottle being situated between a side panel 14 and an oppositely positioned bottle.

Figure 2:
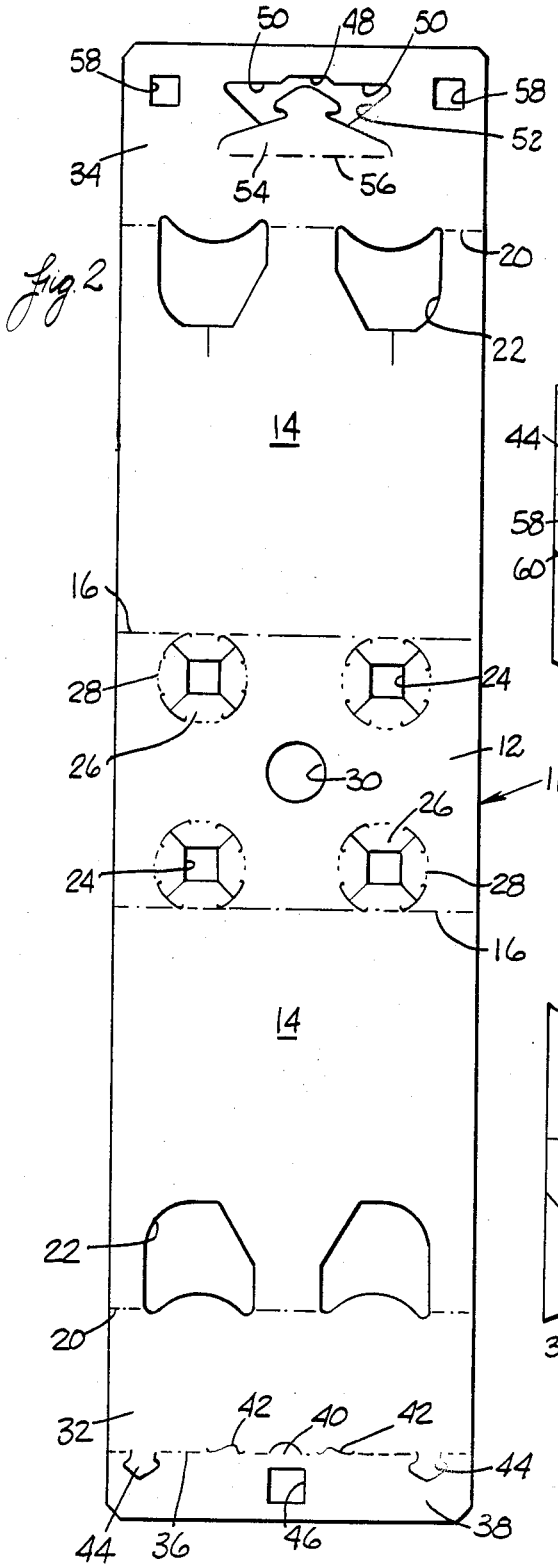
FIG. 2 is a plan view of a production blank for forming the carrier of the present invention.

Referring to FIG. 2, the production blank 11 is used to form the carrier 10 of FIG. 1. The central section 12 of blank 11 corresponds to top panel 12 of the carrier 10 and intermediate sections 14 of the blank correspond to side panels 14 of the carrier. Thus the score lines 16 in FIG. 2 correspond to folds 16 in FIG. 1 and score lines 20 in FIG. 2 correspond to folds 20 in FIG. 1. The reference numerals for the cutouts, for the bottle neck openings and retainers and for the finger grip are the same in the two drawing figures.

Still referring to FIG. 2, the end sections 32 and 34, which are connected to the intermediate sections 14 by score lines 20, are the portions of the blank 11 that correspond to bottom flaps 32 and 34, discussed more fully in connection with FIGS. 3–6. The end sections 32 and 34 when connected form the bottom panel 18 of the carrier 10 shown in FIG. 1. As shown in FIG. 2, end section 32 contains a fold line 36 parallel to and spaced from the end of section 32 to form a margin portion 38. An oversized position tab 40, located generally midway between the side edges of the blank and therefore midway between the ends of a carrier formed from the blank, extends from the fold line 36 away from the margin 38. Also extending from the fold line 36 in the same direction as tab 40 are undersized position tabs 42 which are located on opposite sides of the tab 40. The fold line 36 is interrupted in the location of the tabs 40 and 42 so that they are rigidly connected to the margin 38 and are not folded along the fold line 36. The undersized position tabs extend away from the fold line 36 a distance less than the distance tab 40 extends from the fold line. Tertiary arrow-shaped punch lock tabs 44 are spaced from the side edges of the blank 11 and extend from the fold line 36 toward the margin 38. Preferably the punch lock tabs are foldably connected to the end section 32 by fold line 36 so that the tabs can readily be inserted into their associated female openings, although this is not essential if the neck of the arrow-shaped tab is narrow enough to enable it to be folded down even without a preformed fold line. Also located in the margin 38 generally midway between the side edges of the blank, and therefore midway between the ends of a carrier formed from the blank, is a secondary locking opening 46.

In end section 34 the oversized position primary locking slot or edge 48 is located generally midway between the side edges of the blank to enable it to be engaged by the oversized position tab 40. Extending outwardly toward the side edges of the blank but slightly offset from the edge 48 are undersized position primary locking slots or edges 50 located so as to engage with the undersized position tabs 42. The edges 48 and 50 are part of the cutout 52 into which the secondary punch-style arrow-shaped locking tab 54 extends. The secondary locking tab 54 is positioned to engage the secondary locking opening 46 and is connected to the end section 34 by fold line 56. Preferably the fold line is as long as the combined lengths of edges 48 and 50 to provide a relatively long connection with the end section 34 and improve its resistance to stresses tending to pull the tab 54 from the opening 46. Tertiary locking openings 58 are located in the end section 34 so as to engage with tertiary locking tabs 44.

Figure 3:
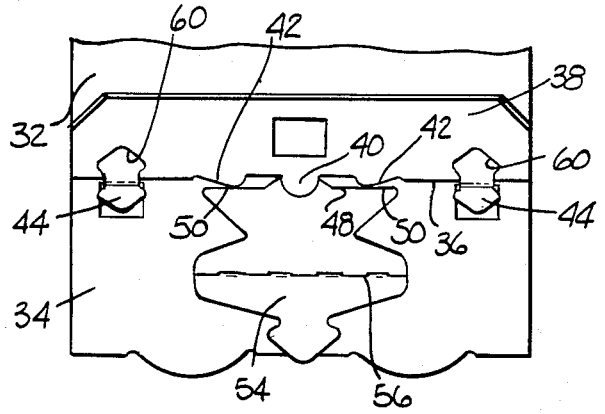
FIG. 3 is a bottom view of the locking portion of the carrier of FIG. 1, showing the oversized position tab engaging its associated slot during the process of locking the bottom flaps together.

In practice, the blank 11 is folded and locked in place to form the carrier 10 by an automatic packaging machine. Although it is not necessary to show the machine itself, the steps involved in forming the mechanical interlocks are illustrated in FIGS. 3–6. Referring to FIG. 3, which shows the bottom of the carrier at the point when the oversized position tab 40 is being engaged with the oversized position slot 48, it will be appreciated that the blank will have been folded about its score lines to form the carrier shape resulting in the bottom flap 32 overlapping the bottom flap 34. The margin 38 is shown folded up about fold line 36 to present the tab 40 to the slot 48. The secondary locking tab 54 is shown folded back about fold line 56 to make room for the engagement of primary locking tab 40 with slot 48, and tertiary locking tabs 44 are shown folded down about the fold line 36, exposing the correspondingly shaped openings 60 previously filled by the tabs 44 prior to their being folded down. This is the relative position of the locking components when oversize bottles cause the oversized tab and slot to be activated. It can be seen that in this condition undersized position locking tabs 42 are spaced from undersized position locking slots 50 and are out of engagement therewith.

Figure 4:
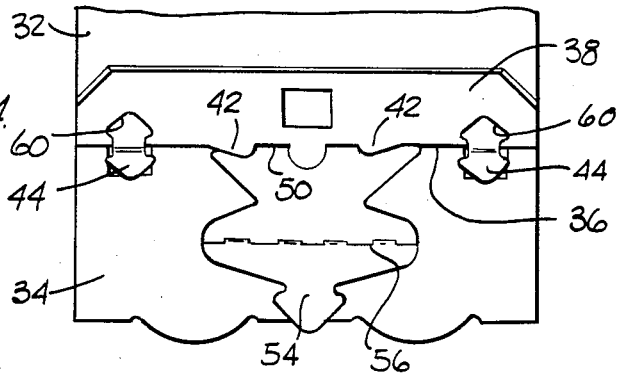
FIG. 4 is a view similar to that of FIG. 3, but showing the undersized position tabs in engagement with their associated slots during the process of locking the bottom flaps together.

FIG. 4 shows the relationship of the locking members when the diameters of the bottles cause an undersized package condition to exist. The secondary and tertiary locking elements are in the same position as shown in FIG. 3, but in this case undersized position primary locking tabs 42 are in locking engagement with the undersized position primary locking slots 50.

Figure 5:
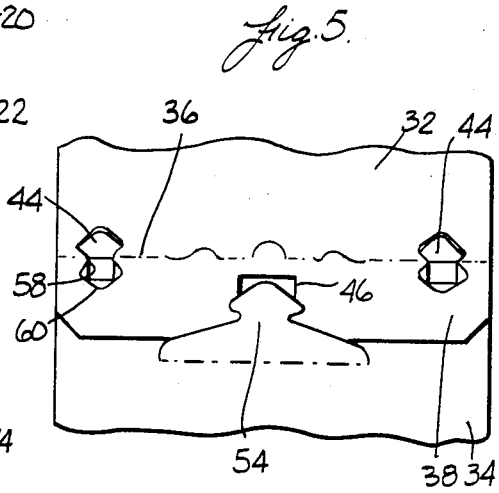
FIG. 5 is a bottom view of the locking portion of the carrier of FIG. 1 after the primary locking means have been engaged and with the secondary and tertiary punch-style locking tabs aligned with their associated female locking openings.

FIG. 5 shows the bottom of the carrier after the margin 38 has been folded down to lock the primary locking tab or tabs in engagement with the associated primary locking slot or slots, and after the secondary locking tab 54 has been aligned with the secondary locking opening 46. In this condition the tertiary locking tabs 44 have been folded back up about the fold line 36 and the arrow-shaped openings 60 are overlying the tertiary locking openings 58 located in the underlying flap 34.

Figure 6:
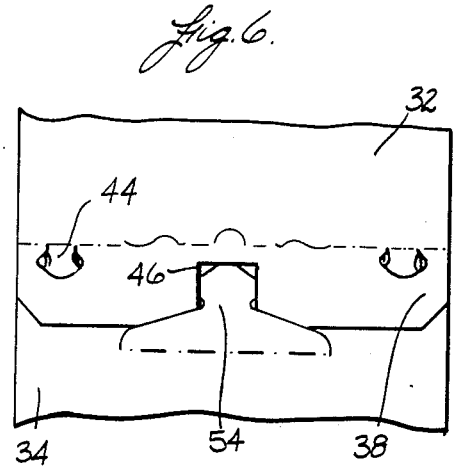
FIG. 6 is a view similar to that of FIG. 5, but showing the secondary and tertiary locking tabs after they have been inserted into their associated female locking openings.

In FIG. 6 the relationship of elements is the same as in FIG. 5 except that the secondary locking tab 54 has been fully inserted into secondary locking opening 46 and tertiary locking tabs 44 have been fully inserted into tertiary locking openings 58. By fully inserted it is meant that the tabs have penetrated entirely through the locking openings. Because the widest dimensions of the secondary and tertiary arrow-shaped punch-style locking tabs 54 and 44 are greater than the width of their associated locking openings 46 and 58, respectively, the tabs resist the tendency to be pulled out of the openings.

Referring to FIG. 7, another embodiment of the invention is incorporated in the blank 70. In this arrangement end sections 32′ and 34′ are connected to the intermediate sections 14′ by score lines 20′. As in the blank of FIG. 2, end section 32′ contains a fold line 36′ to form a margin portion 38′. Instead of a single oversized position tab, however, two oversized position tabs 72 extend from the fold line 36′ away from the margin 38′. Each tab 72 is located adjacent and on opposite sides of the midpoint between the side edges of the blank 70. The oversized position primary locking edge 74 in end section 34′ is located generally centrally of the width of the blank 70 and is of sufficient length to enable both oversized position tabs 72 to contact it when the blank is formed into a carrier. The adjacent offset undersized position primary locking edges 76 extend outwardly toward the side edges of the blank a sufficient distance to enable the undersized position tabs 42′ to contact them. By having two oversized position tabs contact the edge 74 instead of the single oversized position tab of the first embodiment, the bottom flaps remain aligned during the locking of the secondary tab. This overcomes any tendency of the bottom flaps to have relative pivoting or rocking motion due to the single primary locking tab of the first embodiment acting as a pivot point against the locking edge 48. If this were allowed to happen alignment problems could make the insertion of the secondary locking tab into the secondary locking opening difficult. Even with this arrangement the primary oversized position locking tabs are closely spaced so that, as in the first embodiment, there is still room for all the locking elements in the carrier flaps to interact in the same manner as similar elements do in larger carriers to prevent crowding of the elements and consequent weakening of the connecting edges between them.

The secondary punch-style arrow-shaped locking tab 54′ is similar to the tab 54 of the first embodiment and functions in cooperation with the secondary locking opening 46′ in the same manner as the tab 54 of the first embodiment functions in cooperation with opening 46. As an alternative to the punch-style tertiary locking tabs and corresponding openings of the first embodiment, outboard tabs 78 are provided at the ends of the fold line 36′. Tertiary female locking edges 80 are located at the side edges of the end section 34′ so that they will engage the tabs 78 when the blank is folded into carrier form.

Referring to FIG. 8, which corresponds to the view of FIG. 3 and shows the bottom of a carrier formed from the blank of FIG. 7, the bottom flap 32′ overlaps the bottom flap 34′, and the margin 38′ is shown folded up about fold line 36′. In this stage the oversized position locking tabs 72 are presented to the slot edge 74 and the tertiary locking tabs 78 are in position to engage the female edges 80, which are not visible due to being hidden by the tabs 78. As in FIG. 3, the secondary locking tab 54′ is shown folded back about fold line 56′ to make room for the engagement of primary locking tabs 72 with the edge 74. This is the relative position of the locking components of this embodiment when oversize bottles cause the oversized tab and slot to be activated. In this position the undersized locking tabs 42′ are spaced from the undersized locking slots 76.

In FIG. 9 the relative relationships of the locking members are shown when an undersized package condition exists, causing the primary undersized position locking tabs 42′ to become engaged with the slot edges 76. In this position the tabs 78 are still able to be moved into engagement with the slot edges 80.

FIG. 10 shows the bottom of the carrier after the margin 38′ has been folded down to lock either the primary oversized locking tabs or the primary undersized locking tabs in engagement with their associated primary locking slot or slots. The secondary locking tab 54′ has been fully inserted into the secondary locking opening 46′ and the tertiary locking tabs 78 have been engaged with the slots 80. The tabs 72, 42′ and 78 are not visible in this view, since they are behind the end portion of bottom flap 34′ which is covered by the margin position 38′. The outlines which appear similar in shape to the tabs are the cotouts remaining in the bottom flap 32′ after the tabs have been folded out of the plane of the bottom flap 32′.

It should now be understood that in both embodiments the locking components of the bottom panel can have the same relative size and spacing as the corresponding components in six-bottle carriers. Thus proven elements can be retained in the design of the present invention. Surprisingly, however, it has been found that only a single centrally located punch-style arrow-shaped secondary locking tab is needed, and that only a single primary oversized position locking tab or two closely spaced primary oversized position locking tabs are needed. By making a single element perform the function of two elements or, in the case of closely spaced oversized position locking tabs, making two closely spaced elements perform the function previously performed by two relatively widely spaced elements, the desired dimensional relationships between the locking elements discussed above have been retained and the need to increase the caliper of the paperboard in order to make it stronger has been avoided.

It should now be obvious that although a preferred embodiment of the invention has been described, changes to certain specific details of the embodiment can be made without departing from the spirit and scope of the invention as defined in the claims.

What is claimed is:

1. A four-bottle wrap-around carrier for holding two adjacent rows of bottles, each row containing only two adjacent bottles, comprising:

a top panel;

a bottom panel;

two side panels foldably connected to the top and bottom panels, each side panel containing two cutouts for receiving the bottom portions of the two bottles in the adjacent row of bottles;

the bottom panel comprising two overlapping and interlocking flaps foldably connected to the side panels;

the overlying flap having a primary male adjustable locking portion comprising oversized position tab means and undersized position tab means, the oversized position tab means being located substantially at the midpoint between the ends of the carrier and the undersized position tab means being located between the oversized position tab means and the ends of the carrier;

the underlying flap having a primary female adjustable locking portion comprising a single oversized position slot edge located so as to be engaged by the oversized position tab means and undersized position slot edges located so as to be engaged by the undersized position tab means;

the oversized position tab means engaging the oversized position slot edge when the size of the bottles in the carrier causes the girth of the carrier to be relatively great, and the undersized position tab means engaging the undersized position slot edges when the size of the bottles in the carrier causes the girth of the carrier to be relatively small;

the underlying flap having a secondary punch-style arrow-shaped male locking tab located generally midway between the ends of the carrier;

the overlying flap having a secondary punch-style female locking opening located generally midway between the ends of the carrier and being engaged by the secondary punch-style male locking tab; and interlocked male and female tertiary locking means on the overlying and underlying bottom flaps.

2. A four-bottle wrap-around carrier for holding two adjacent rows of bottles, each row containing only two adjacent bottles, comprising:

a top panel;

a bottom panel;

two side panels foldably connected to the top and bottom panels, each side panel containing two cutouts for receiving the bottom portions of the two bottles in the adjacent row of bottles;

the bottom panel comprising two overlapping and interlocking flaps foldably connected to the side panels;

the overlying flap having a primary male adjustable locking portion comprising oversized position tab means and undersized position tab means, the oversized position tab means being located generally midway between the ends of the carrier and the undersized position tab means being located between the oversized position tab means and the ends of the carrier;

the underlying flap having a primary female adjustable locking portion comprising an oversized position slot edge adapted to be engaged by the oversized position tab means and undersized position slot edges adapted to be engaged by the undersized position tab means;

the oversized position tab means engaging the oversized position slot edge when the size of the bottles in the carrier causes the girth of the carrier to be relatively great, and the undersized position tab means engaging the undersized position slot edges when the size of the bottles in the carrier causes the girth of the carrier to be relatively small;

the underlying flap having a secondary punch-style arrow-shaped male locking tab located generally midway between the ends of the carrier;

the overlying flap having a secondary punch-style female locking opening located generally midway between the ends of the carrier and being engaged by the secondary punch-style male locking tab; and interlocked male and female tertiary locking means on the overlying and underlying bottom flaps;

the oversized position tab means comprising a single tab located generally midway between the ends of the carrier, and the undersized position tab means comprising two tabs, one undersized position tab means being located between the oversized position tab and one of the ends of the carrier and the other undersized position tab being located between the oversized position tab and the other end of the carrier.

3. A four-bottle wrap-around carrier for holding two adjacent rows of bottles, each row containing only two adjacent bottles, comprising:

a top panel;

a bottom panel;

two side panels foldably connected to the top and bottom panels, each side panel containing two cutouts for receiving the bottom portions of the two bottles in the adjacent row of bottles;

the bottom panel comprising two overlapping and interlocking flaps foldably connected to the side panels;

the overlying flap having a primary male adjustable locking portion comprising oversized position tab means and undersized position tab means, the oversized position tab means being located substantially at the midpoint between the ends of the carrier and the undersized position tab means being located between the oversized position tab means and the ends of the carrier;

the underlying flap having a primary female adjustable locking portion comprising a single oversized position slot edge located so as to be engaged by the oversized position tab means and undersized position slot edges located so as to be engaged by the undersized position tab means;

the oversized position tab means engaging the oversized position slot edge when the size of the bottles in the carrier causes the girth of the carrier to be relatively great, and the undersized position tab means engaging the undersized position slot edges when the size of the bottles in the carrier causes the girth of the carrier to be relatively small;

the underlying flap having a secondary punch-style arrow-shaped male locking tab located generally midway between the ends of the carrier;

the overlying flap having a secondary punch-style female locking opening located generally midway between the ends of the carrier and being engaged by the secondary punch-style male locking tab; and interlocked male and female tertiary locking means on the overlying and underlying bottom flaps;

the oversized position tab means comprising two adjacent tabs, each being adjacent and on either side of the midpoint between the ends of the carrier, and the undersized position tab means comprising two tabs, each undersized position tab being located between one of the oversized position tabs and the nearest end of the carrier.

* * * * *